US005194210A

United States Patent [19]

Lommerts et al.

[11] Patent Number: 5,194,210

[45] Date of Patent: Mar. 16, 1993

[54] PROCESS FOR MAKING POLYKETONE FIBERS

[75] Inventors: Bert J. Lommerts, MD Dieren; Jan Smook, DH Dieren; Bastiaan Krins, Westervoort, all of Netherlands; Andrzej M. Piotrowski, Peekskill; Elliot I. Band, North Tarrytown, both of N.Y.

[73] Assignee: Akzo NV, Arnhem, Netherlands

[21] Appl. No.: 694,630

[22] Filed: May 2, 1991

[30] Foreign Application Priority Data

May 9, 1990 [EP] European Pat. Off. ..... 9020117.4
Jul. 9, 1990 [EP] European Pat. Off. ..... 90201827.4

[51] Int. Cl.[5] ..... D01F 6/00

[52] U.S. Cl. ..... 264/184; 264/203; 264/210.8

[58] Field of Search ..... 264/184, 203, 210.8

[56] References Cited

U.S. PATENT DOCUMENTS 5,064,580 11/1991 Beck et al. ..... 264/184 X

FOREIGN PATENT DOCUMENTS 711166 6/1965 Canada .
360358 3/1990 European Pat. Off. .
1327017 4/1963 France .
WO90/14453 11/1990 PCT Int'l Appl. .

*Primary Examiner*—Leo B. Tentoni
*Attorney, Agent, or Firm*—Richard P. Fennelly; Louis A. Morris

[57] ABSTRACT

Fibers of an alternating carbon monoxide-ethylene polymer having a molecular weight of at least 100,000 g/mole and a birefringence of at least $650\times10^{-4}$ can be formed by first extruding a solution of the polymer in a mixed solvent system comprising an aromatic alcohol which is free of alkyl substituents on the aromatic nucleus and another solvent which is a liquid and is other than an aromatic alcohol. The extrusion into the solvent is at an extrusion rate of at least 1 m/min and forms a solvent-containing article which is then cooled or coagulated in a non-solvent for the polymer. The solvent is removed by extraction with a non-solvent for the polymer which is soluble in the mixture of solvents and the resulting article is drawn at a temperature of at least 180° C.

28 Claims, No Drawings

PROCESS FOR MAKING POLYKETONE FIBERS

FIELD OF THE INVENTION

The invention relates to novel fibers of linear alternating polymers of carbon monoxide and ethylene The polymer is also referred to as poly(ethyleneketone), polyketone, or poly(ethene-alt-carbonmonoxide), and it has the following repeating unit in the chain molecule:

$$-CH_2-CH_2-\overset{\overset{\displaystyle O}{\|}}{C}-$$

Additionally, the invention relates to a novel process for the production of polyketone fibers.

BACKGROUND OF THE INVENTION

European Patent Application No. 360,358 describes a process for the preparation of polyketone fibers which are said to be useful as a reinforcing material. The fibers are made by successively spinning a solution of a polyketone, removing the solvent from the obtained fibers, and stretching the fibers at an elevated temperature. According to the specification and the Examples of European Patent Application No. 360 358, the solvents advantageously employed for preparing the polymer solution are hexafluoroisopropanol, m-cresol, and mixtures thereof. Moreover, minor amounts of compounds that are non-solvents for the polyketones may be employed in combination with the solvents mentioned hereinbefore. Such compounds include, among others, ketones such as acetone, with ethanol being mentioned as a preferred non-solvent. International Patent Application (PCT) No. WO 90/14453, published after the priority date of the present application, describes polyketone fibers and a method for the production of such fibers. The fibers are made by successively dissolving the polyketone in a suitable solvent, spinning the solution, removing all or some of the solvent from the spun fiber and stretching the fiber at elevated temperature. The solvent preferentially used for preparing the spinning solution is chosen from the group consisting of hexafluoroisopropanol, m-cresol, phenol, pyrrole, 2- chlorophenol, and 3-chlorophenol. A non-solvent for the polyketone may be used to stimulate the separation of the polyketone from the solvent in the spun object. Suitable non-solvents for this conversion are acetone, methyl ethyl ketone, and toluene. Although the processes of European Patent Application No. 360 358 and International Patent Application No. WO 90/14453 may provide polyketone fibers having properties which make them useful for some end-uses, improvements are desired with respect to the cost and the toxicity of the spinning solvents used, the speed of the spinning process, and the mechanical properties of the resulting fibers.

SUMMARY OF THE INVENTION

The present invention involves a novel fiber of an alternating carbon monoxide ethylene polymer having an estimated molecular weight of at least 100 000 g/mole, which fiber has a birefringence of at least $650\times10^{-4}$.

The invention also involves a novel spinning process for making polyketone fibers.

DETAILED DESCRIPTION OF THE INVENTION

The Polymer

The polymer forming the fiber of the invention is an alternating polymer of carbon monoxide and ethylene. It is highly preferred that the polymer be a pure homopolymer because, in that case, optimum fiber properties are obtained. However, small amounts of other units are acceptable, as long as the polymer molecules consist in essence of chain units of the type:

$$[-CH_2-CH_2-\overset{\overset{\displaystyle O}{\|}}{C}-]$$

This is the case when the other units are present in an amount which does not exceed 5 mole percent. Alternatively, it is possible to mix a polyketone with a terpolymer, on the condition that the total mixture does not contain more than 5 mole percent of units different from the following unit:

$$[-CH_2-CH_2-\overset{\overset{\displaystyle O}{\|}}{C}-]$$

The polymer is well-known in the art and many processes for making it have been described, e.g., in U.S. Pat. No. 3,689,460. The polymer to be used in the invention should have an estimated molecular weight (MW) of at least 100,000. The estimated molecular weight can be determined by measuring the Intrinsic Viscosity (IV) in a solution of meta-cresol. The Intrinsic Viscosity is also referred to as Limiting Viscosity Number, or LVN, and is expressed in dl/g. The relation between the estimated molecular weight (in g/mole) and the IV (in dl/g), as measured in meta-cresol at 25° C., can be given by the formula:

$$IV=1.0\times10^{-4}\times MW^{0.85}$$

As is usual with polymer fibers, the tensile properties, especially the tenacity, are more favorable as the MW is higher. Therefore, the aim is to obtain the highest possible MW, but this is subject to practical restrictions in that there are limits as to production and processability. Since making the fiber of the invention requires the preparation of a spinning dope, the maximum MW that can be used is about 1,000,000. For practical purposes the preferred polymer has an IV in the range of 2 to 20.

Processes for making the polymers also have been described in European Patent Specification Nos. 121,965; 222,454; 224,304; 227,135; 228,733; 229,408; 235,865; 235,866; 239,145; 245,893; 246,674; 246,683; 248,483; 253,416; 254,343; 257,663; 259,914; 262,745; 263,564; 264,159; 272,728, and 277,695.

The polymers always are a mixture of molecules of different molecular weights, preference being given to those in which the MW distribution is as small as possible.

The Process for Making the Fiber

The fiber of the invention can be made by a spinning process comprising preparing a dope from the polymer and a special mixture of solvents and subsequently extruding it into elongated structures at a temperature at which it is liquid. Next, the structures are solidified to form solid articles from which the solvent is removed by extraction with a non-solvent for the polymer which is soluble in the dope solvent, after which they are stretched or drawn. When solidification takes place by thermo-reversible crystallization, this process is usually referred to as gel spinning. When it takes place by crystallization due to extraction of the solvent, i.e. coagulation, the process is referred to as wet spinning A very efficient spinning process is the so-called air gap spinning process or dry jet-wet spinning process. This process per se is old in the art, having been described as early as 1961, see e.g. Canadian Patent Specification No. 711,166 or French Patent No. 1,327,017.

The Dope Solvents

Although a great number of organic compounds can be used to dissolve the polymer, most of these cannot be utilized as a dope solvent in the process of the invention. The dope solvent should meet a number of requirements, e.g.:

- low toxicity
- easy to recycle
- not too low boiling point
- not too expensive
- solubility in liquids that can be used as a spinning bath
- stable under the process conditions
- chemically inert in relation to the polymer
- combination with the polymer should give spinnable solutions, i.e. the solutions should contain enough of the polymer for a commercial spinning range, and the crystallization of the polymer from the solvent should be neither too slow nor too rapid.

According to European Patent Application No. 360,358 and International Patent Application No. WO 90/14453, hexafluoro-isopropanol may advantageously be used as a solvent for spinning polyketones. Although this compound is a very good solvent for the polymer, it is too toxic and expensive for commercial use. Moreover, its use does not result in fibers having the excellent mechanical properties which can be achieved according to the present invention. Also too toxic for use in actual practice are compounds such as orthochlorophenol and chloropropanol.

European Patent Application No. 360,358 and International Patent Application No. WO 90/14453 also disclose meta-cresol as an advantageous solvent. Although this compound, as well as other aromatic alcohols such as phenol, hydroquinone, and resorcinol, is a satisfactory solvent, the polymer does not crystallize readily from solutions in these solvents and so their use will lead to spinning speeds which are too low for commercial practice.

Although other compounds such as ethylene carbonate and propylene carbonate can dissolve the polymer at high temperatures, their use is attended with the polymer crystallizing too rapidly and in too coarse a form during cooling, so that the resulting yarns do not have acceptable mechanical properties.

According to the present invention use is made of a process in which a solution of the polymer in a mixture of solvents, at least one of which is an aromatic alcohol being free of alkyl radical substituents on the aromatic nucleus and another is a liquid other than an aromatic alcohol, is extruded into a shaped solvent-containing article at an extrusion rate of at least 1 m/min, after which the article is solidified by cooling or coagulating, and the solvent is removed from it by extraction with a non-solvent for the polymer which is soluble in the mixture of solvents, whereupon the article is drawn at a temperature of at least 180° C.

Preferably the extrusion rate is at least 3 m/min.

Preferably the article is drawn at a draw rate of at least 5, more preferably of at least 10.

Excellent results were obtained according to the invention with mixtures of (a) ethylene carbonate or propylene carbonate and (b) an aromatic alcohol being free of alkyl radical substituents on the aromatic nucleus, in which the (a):(b) weight ratio is in the range of 1:1 to 19:1.

Preferred aromatic alcohols being free of alkyl radical substituents on the aromatic nucleus are phenol, resorcinol, and hydroquinone.

Other preferred components of the spinning dope are acetone and water.

A most preferred mixture of solvents used for preparing the polymer solution of this invention comprises resorcinol and water. The weight ratio of resorcinol to water in such a mixture may be in the range of from 1:2 to 20:1. Preferably it is in the range of from 2:1 to 5:1.

Other non-aromatic alcoholic liquids that may be used in admixture with the aromatic alcohols are, e.g.:

1,6-hexanediol
1,4-butanediol
benzyl alcohol
di-ethylene glycol
ethylene glycol
glycerol
tri-ethylene glycol
epsilon caprolactam
dimethyl phthalate
dimethyl sulfoxide
phosphoric acid
N-methyl-2-pyrrolidone
alpha pyrrolidone.

The polymer content of the solutions of this invention is generally in the range of from 1 to 50 per cent by weight, preferably in the range of from 5 to 30 per cent by weight.

Crystalline Properties

The fibers according to the invention have a much higher birefringence than the prior art polyketone fibers, such as the fibers obtained by the process disclosed in European Patent Application 360,358. The values for the fibers according to the invention are at least $650\times10^{-4}$, preferably at least $659\times10^{-4}$. Optimum fibers have a birefringence of at least $670\times10^{-4}$. The maximum which can be attained is about $750\times10^{-4}$. The extraordinarily high birefringence of the fibers of this invention is related to their unique mechanical properties, i.e. very high initial modulus and tenacity.

Fiber X-ray diffraction photographs can be taken of the fibers of the invention using a precession camera with CuK$\alpha$ radiation.

The fibers according to the invention display a unique crystallographic pattern with d-spacings of the three major reflections at the equator of 4.09–4.13, 3.43–3.49, and 2.84–2.90Å, and so are to be preferred, since only the homopolymers show major equator reflections in this range.

The fibers according to the invention have their crystals arranged mainly in the direction of the fiber axis, which means that the orientation angle (OA) is low. In FIG. 1 a wide-angle x-ray diffraction pattern of a fiber according to the invention is shown.

The fibers consist of a mixture of crystalline and amorphous material Ideally, fibers should be completely crystalline. Given that the density is affected by the amount of amorphous material, density measurements will give an impression of the crystallinity. Fibers of the invention have a density in the range of 1.25–1.38 g/cm$^3$, the upper values in this range, more especially those in the range of 1.31–1.38 g/cm$^3$, being preferred.

Although the melting point, $T_m$, of the homopolymer from which the yarns are made is about 257° C. (obviously the inclusion of small amounts of terpolymer will reduce the $T_m$), the crystalline structure of the yarn preferably is such that it will not melt below 265° C. The special spinning process according to the invention raises the melting point by 4 to 23 degrees centigrade. The higher the molecular weight of the polymer, the higher the rise in melting point will be. The melting point of the fibers of the invention is an indication of their quality in the sense that a higher melting point represents a higher crystallinity. Preference is given to fibers having a melting point of from 265° to 280° C., preferably of from 270° to 280° C. The melting point is the peak melting temperature in DSC-thermograms determined with a Perkin Elmer® DSC7 at a scan speed of 20° C./min on samples of pieces of fiber of about 1–5 mg in weight and 1–5 mm in length. The DSC apparatus is calibrated by recording thermograms on Indium test samples.

Properties of the Fibers of the Invention

The fibers of the invention have very attractive properties, rendering them suitable for use in industrial applications, for instance as reinforcing yarns for rubber articles such as tires and conveyor belts. They can also be used in woven or non-woven textiles, for reinforcing roofing membranes, and for geo-textiles. In general, the fibers of the invention can replace such conventional industrial yarns as those of rayon, nylon, polyester and aramid.

The yarns have a high tensile strength What makes them especially valuable is their high creep resistance, which is not only greatly superior to that of the high-modulus polyethylene yarns but also to that of polyethylene terephthalate yarns.

The fibers of this invention can be used as filamentary yarns composed of endless filaments, which yarns may be twisted and treated in the usual way with adhesion promoters and other treatments to enhance their properties.

The fibers may also be transformed, with crimping or not, into staple fibers. Alternatively, they can be transformed into pulp by the usual processes known for this purpose. The pulp thus obtained is useful for the reinforcement of friction materials, asphalt, concrete, etc., and as a substitute for asbestos.

Measurements and Tests

Inherent Viscosity (IV)

IV is defined by the equation:

$$IV = \lim_{c \to o} \frac{n_{spec}}{c}$$

wherein c is the concentration of the polymer solution and $n_{spec}$ (specific viscosity) is the ratio between the flow times t and $t_o$ of the polymer solution and the solvent, respectively, as measured in a capillary viscometer at 25° C. The solvent used is meta-cresol. The specific viscosity thus is:

$$n_{spec} = \frac{t - t_o}{t_o}$$

The IV test is conducted in meta-cresol at 25° C. The polymer is dissolved by being mixed in the solvent at 135° C. for 15 minutes. The polymer concentration is dependent on the expected IV and is selected as follows:

| Expected IV: | chosen concentration: |
|---|---|
| 0–0.5 | 0.2–1.0 g/dl |
| 0.5–1.0 | 0.2–0.8 g/dl |
| 1.0–3.0 | 0.1–0.25 g/dl |
| 3.0–5.0 | 0.07–0.12 g/dl |
| >5.0 | 0.03–0.06 g/dl |

Fiber Properties

Filament properties are measured on fibers that have been conditioned at 20° C. and 65% relative humidity for at least 24 hours. Tenacity (i.e., breaking tenacity), Elongation (breaking elongation), and Initial Modulus are obtained by breaking a single filament or a multifilament yarn on an Instron tester. The gauge length for single broken filaments is 10 cm. The results for 3 filaments are averaged. All samples are elongated at a constant rate of extension of 10 mm/min.

The filament count (expressed in tex) is calculated on the basis of functional resonant frequency (A.S.T.M. D 1577-66, part 25, 1968) or by microscopic measurement.

The tenacity, elongation, and initial modulus as defined in A.S.T.M. D 2256-88, published April 1988, are obtained from the load-elongation curve and the measured filament count.

The tenacity and initial modulus are expressed in units GPa and mN/tex. For ease of comparison the meaning of these parameters and the relation between them is as follows:

$$1\ GPa = 10^9\ N/m^2$$

$$1\ mN/tex = 10^{-1}\ N/tex$$

$$1\ Gpa = 1000 \cdot mN/tex\ (density\ of\ the\ solid\ material\ in\ g/cm^3)$$

density

The preferred fibers of this invention have a tenacity (T) of at least 1300 mN/tex, more particularly of at least 1500 mN/tex, and an initial modulus (M) of at least 35 N/tex, more particularly of at least 50 N/tex. The elongation at break of the fibers of the invention preferably is in the range of from 2.5% to 1.0%.

Tex is the number equal to the weight in grams of 1000 m of yarn. The average values for tenacity and modulus for known yarns are:

Polyparaphenylene terephthalamide:

T=3 GPa (2100 mN/tex)

M=120 GPa (84 N/tex)

Steel:

T=2.8 GPa (360 mN/tex)

M=200 GPa (26 N/tex)

Birefringence

The birefringence can be measured in accordance with the method described by H. de Vries in Rayon Revue 1953, p. 173–179. The fiber is immersed in dibutyl phthalate and use is made of light having a wavelength of 558.5 nm. The results of 10 measurements are averaged

EXAMPLES

Use was made of a homopolymer of carbon monoxide and ethylene. The intrinsic viscosity values were determined in meta-cresol at 25° C. In some of the experiments the tenacity of the obtained fiber is given in GPa (which is the same as $GN/m^2$); in these cases the cross-section of the fiber was determined microscopically. Where the tenacity is given in mN/tex, the linear density of the fiber was determined with a vibroscope.

In all the examples the polymer was dissolved in the mixture of solvents, with heating and stirring, until a homogeneous solution was obtained. The solution was then placed under vacuum until the gas bubbles had disappeared. At the temperature indicated in Table 1 the spinning dope thus obtained was spun through a spinneret into a spinning bath, as indicated in Table 1. After having been washed free of the dope solvent, the yarn was wound onto a spool and dried. The yarn was then drawn at the temperatures and draw ratios given in Table 1 . The properties of the thus obtained yarns are given in Table 2.

The spinnerets used in the examples had:

Example 1: 1 capillary of a diameter of 300 microns
Example 2: 1 capillary of a diameter of 500 microns
Example 3: 1 capillary of a diameter of 500 microns
Example 4: 6 capillaries of a diameter of 250 microns
Example 5: 6 capillaries of a diameter of 250 microns
Example 6: 1 capillary of a diameter of 500 microns
Example 7: 6 capillaries of a diameter of 125 microns The extrusion and winding rates and the air gap lengths in the examples were as follows:

| Example: | Extrusion rate | Winding rate | Air gap length |
|---|---|---|---|
| 1 | 3.24 m/min | 0.49 m/min | no air gap |
| 2 | 1.99 m/min | 2.00 m/min | 10 mm |
| 3 | 1.99 m/min | 2.00 m/min | 10 mm |
| 4 | 2.99 m/min | 3.00 m/min | 5 mm |
| 5 | 2.99 m/min | 3.50 m/min | 8 mm |
| 6 | 1.99 m/min | 2.00 m/min | 10 mm |
| 7 | 5.70 m/min | 0.42 m/min | 20 mm |

If conditions are not optimal during the manufacturing process the resulting fibers will not, of course, exhibit the high level of mechanical properties in all cases.

TABLE 1

| | | Spinning conditions | | |
|---|---|---|---|---|
| Ex. | Spinning Dope | Spinning Bath | Drawing Temp. °C. | Draw Ratio |
| 1 | 1.02 parts polymer of IV = 6.1<br>12.45 parts phenol<br>1.25 parts acetone<br>T = 20° C. | acetone Temp. = −5° C. | a.<br>b. 225<br>c. 225<br>d. 225<br>e. 225<br>f. 225<br>g. 225<br>h. 225<br>i. 225<br>j. 225<br>k. 225 | 1<br>2.5<br>3<br>4<br>5<br>6<br>7.5<br>8<br>10<br>12.5<br>12.8 |

TABLE 1-continued

| | | Spinning conditions | | |
|---|---|---|---|---|
| Ex. | Spinning Dope | Spinning Bath | Drawing Temp. °C. | Draw Ratio |
| | | | l. 225<br>m. 225/250<br>n. 225<br>o. 225/250<br>p. 225/250<br>q. 225/250 | 15<br>15<br>16<br>17.5<br>18<br>20 |
| 2 | 8 parts polymer of IV = 6.1<br>64.8 parts phenol<br>7.2 parts acetone<br>T = 110° C. | acetone Temp. = −4° C. | a. 175/225/250<br>b. 175/225/250<br>c. 175/225/260<br>d. 175/225/260<br>e. 175/225/260<br>f. 225/260 | 15<br>16<br>15<br>16<br>17<br>25.5 |
| 3 | 7 parts polymer of IV = 6.1 | acetone Temp. = 10° C. | a. 175/225/250 | 5/2 (total 10)/1.5 (total 15) |
| | | | b. " | 5/2 10)/1.6 (total 16) |
| | 56.7 parts phenol<br>6.3 parts acetone<br>T = 115° C. | | c. " | 5/2 (total 10)/1.7 (total 17) |
| 4 | 7 parts polymer of IV = 5.46<br>69.35 parts propylene carbonate<br>3.65 parts hydroquinone<br>T = 210° C. | acetone Temp. = −15° C. | 225<br>a. 225/250<br>b. 225/250<br>c. 225/250<br>d. 225/250 | first step 8<br>total 15<br>total 16<br>total 17<br>total 18 |
| 5 | 6.4 parts polymer of IV = 5.46<br>43.8 parts propylene carbonate<br>29.8 parts resorcinol<br>T = 175° C. | acetone Temp = −15° C. | a. 225<br>b. 225/250<br>c. 225/250<br>d. 225/255<br>e. 225/255<br>f. 225/256 | 5<br>10<br>15<br>18<br>19<br>19 |
| 6 | 10.5 parts polymer of IV = 3.89<br>53.55 parts phenol<br>5.95 parts acetone<br>T = 115° C. | acetone T = −15° C. | a. 175/225/260<br>b. 175/225/260<br>c. 175/225/260<br>d. 175/225/260 | 15<br>16<br>17<br>18 |
| 7 | 7.2 parts polymer of IV = 5.46<br>54.6 parts resorcinol<br>18.2 parts water<br>T = 100° C. | acetone T = −15° C. | a. 243/257/260<br>b. 243 | 20.4<br>11.3 |

TABLE 2

| | Fiber properties | | | | |
|---|---|---|---|---|---|
| Ex. | Tenacity GPa | In. modulus GPa | Elongation at break % | Birefringence $10^{-4}$ | $T_m$ °C. |
| 1a | 0.25 | 1.9 | | 55 | |
| 1b | | | | 388 | |
| 1c | 0.64 | 9.5 | 9.6 | | |
| 1d | 0.93 | 11.0 | 9.7 | | |
| 1e | | | | 533 | |
| 1f | 1.20 | 16.5 | 9.2 | | |
| 1g | | | | 584 | |
| 1h | 1.55 | 20.3 | 8.9 | | |
| 1i | 1.50 | 22.4 | 6.9 | 626 | |
| 1j | | | | 633 | |
| 1k | 1.63 | 30.7 | 6.2 | | |
| 1l | | | | 665 | |
| 1m | | | | 670 | |
| 1n | | | | | 269 |
| 1o | | | | 659 | |
| 1p | 1.9 | 51.2 | 5.0 | | |
| 1q | 2.1 | 55.0 | 3.6 | 685 | |
| 2a | 1271 | 34.6 | 4.05 | 670 | 271 |

TABLE 2-continued

| Ex. | Tenacity GPa | In. modulus GPa | Elongation at break % | Birefringence $10^{-4}$ | $T_m$ °C. |
|---|---|---|---|---|---|
| | Fiber properties | | | | |
| 2b | 1335 | 34.0 | 4.31 | | 271 |
| 2c | 1430 | 33.2 | 4.57 | | 272 |
| 2d | 1360 | 34.8 | 4.25 | | 273 |
| 2e | 1354 | 38.4 | 3.93 | 678 | 272 |
| 2f | 169.2 | 58.8 | 3.2 | | |
| 3a | 1047 | 21.3 | 5.04 | | |
| 3b | 1141 | 23.6 | 4.98 | | |
| 3c | 1376 | 31.8 | 4.67 | | |
| 4a | 952 | 9.92 | 7.76 | | 261 |
| 4b | 1065 | 12.2 | 7.32 | | 262 |
| 4c | 950 | 13.2 | 6.35 | 609 | 263 |
| 4d | 1139 | 15.5 | 6.46 | | 264 |
| 5a | 215 | 3.02 | 10.10 | | 259 |
| 5b | 396 | 4.94 | 7.93 | | 264 |
| 5c | 883 | 9.35 | 7.62 | | 265 |
| 5d | 1020 | 12.0 | 7.40 | | 265 |
| 5e | 1172 | 14.8 | 7.24 | | 266 |
| 5f | 976 | 12.0 | 6.85 | 587 | 267 |
| 6a | 1470 | 23.6 | 6.22 | 631 | 264 |
| 6b | 1449 | 26.2 | 5.62 | | 271 |
| 6c | 1307 | 29.7 | 4.70 | | 265 |
| 6d | 1170 | 30.6 | 4.16 | 665 | 264 |
| 7a | 1624 | 37.0 | 4.70 | | 277 |
| 7b | 1048 | 18.0 | 5.40 | | 274 |

From the fibers of three examples WAXD-recordings were taken revealing equator reflections being in accordance with the following d-spacings:

| Example | d(110) | d(200) | d(210) |
|---|---|---|---|
| 2e | 4.110 | 3.454 | 2.86 |
| 4d | 4.107 | 3.476 | 2.88 |
| 5e | 4.109 | 3.462 | 2.86 |

We claim:

1. A process for making a high tensile strength and high modulus fiber from a linear alternating polymer of carbon monoxide and ethylene having an estimated molecular weight of at least 100,000 g/mol, which process comprises extruding a solution of the polymer in a mixture of solvents, at least one of which is an aromatic alcohol being free of alkyl radical substituents on the aromatic nucleus and another of which is a liquid other than an aromatic alcohol, into a shaped solvent-containing article at an extrusion rate of at least 1 m/min, the article solidifying by cooling or coagulating in a non-solvent for the polymer, and the solvent being removed from it by extraction with a non-solvent for the polymer which is soluble in the mixture of solvents, whereupon the article is drawn at a temperature of at least 180° C.

2. A process according to claim 1 wherein the article is drawn at a draw ratio of at least 10.

3. A process according to claim 1 wherein the solution of the polymer is spun into a fiber in an air gap spinning process.

4. A process according to claim 2 wherein the solution of polymer is spun into a fiber in an air gap spinning process.

5. A process according to claim 1 wherein the fiber is formed at a rate of at least 3 m/min.

6. A process according to claim 2 wherein the fiber is formed at a rate of at least 3 m/min.

7. A process according to claim 3 wherein the fiber is formed at a rate of at least 3 m/min.

8. A process according to claim 1 wherein the mixture of solvents comprises (a) ethylene carbonate or propylene carbonate and (b) an aromatic alcohol in which the (a):(b) weight ratio is in the range of 1:1 to 19:1.

9. A process according to claim 2 wherein the mixture of so comprises (a) ethylene carbonate or propylene carbonate and (b) an aromatic alcohol in which the (a):(b) weight ratio is in the range of 1:1 to 19:1.

10. A process according to claim 3 wherein the mixture of so lvents comprises (a) ethylene carbonate or propylene carbonate and (b) an aromatic alcohol in which the (a):(b) weight ratio is in the range of 1:1 to 19:1.

11. A process according to claim 4 wherein the mixture of comprises (a) ethylene carbonate or propylene carbonate and (b) an aromatic alcohol in which the (a):(b) weight ratio is in the range of 1:1 to 9:1.

12. A process according to claim 1 wherein the aromatic alcohol is resorcinol.

13. A process according to claim 2 wherein the aromatic is resorcinol.

14. A process according to claim 3 wherein the aromatic alcohol is resorcinol.

15. A process according to claim 4 wherein the aromatic alcohol is resorcinol.

16. A process according to claim 1 wherein the liquid which is not an aromatic alcohol is acetone.

17. A process according to claim 2 wherein the liquid which is not an aromatic alcohol is acetone.

18. A process according to claim 3 wherein the liquid which is not an aromatic alcohol is acetone.

19. A process according to claim 4 wherein the liquid which is not an aromatic alcohol is acetone.

20. A process according to claim 1 wherein the liquid which is not an aromatic alcohol is water.

21. A process according to claim 2 wherein the liquid which is not an aromatic alcohol is water.

22. A process according to claim 3 wherein the liquid which is not an aromatic alcohol is water.

23. A process according to claim 4 wherein the liquid which is not an aromatic alcohol is water.

24. A process according to claim 1 wherein the mixture of solvents used for preparing the solution of the polymer comprises resorcinol and water.

25. A process according to claim 2 wherein the mixture of solvents used for preparing the solution of the polymer comprises resorcinol and water.

26. A process according to claim 3 wherein the mixture of solvents used for preparing the solution of the polymer comprises resorcinol and water.

27. A process according to claim 4 wherein the mixture of solvents used for preparing the solution of the polymer comprises resorcinol and water.

28. A process according to claim 24 wherein the weight ratio of resorcinol to water is in the range of from 2:1 to 5:1.

* * * * *

UNITED STATES PATENT AND TRADEMARK OFFICE

CERTIFICATE OF CORRECTION

PATENT NO. : 5,194,210

DATED : March 16, 1993

INVENTOR(S) : Bert J. Lommerts et al.

It is certified that error appears in the above—identified patent and that said Letters Patent is hereby corrected as shown below:

Col. 6, lines 48-50, the expressions "1 mN/tex=$10^{-1}$ N/tex" and "1 Gpa=1000·mN/tex" should read -- 1 mN/tex = $10^{-3}$ N/tex -- and -- 1 GPa = $\frac{1000}{\text{density}}$. mN/tex --, respectively; and Col. 8, line 68, the following heading should appear between the data for "Ex. 1q" and "Ex. 2a":

| Ex. | Tenacity mN/tex | In. modulus N/tex | Elongation at break % | Birefringence $10^{-4}$ | $T_m$ °C |
|---|---|---|---|---|---|

Signed and Sealed this

Eighteenth Day of January, 1994

Attest:

Bruce Lehman

BRUCE LEHMAN

Attesting Officer

Commissioner of Patents and Trademarks